US009721549B2

(12) United States Patent
Sikra et al.

(10) Patent No.: US 9,721,549 B2
(45) Date of Patent: Aug. 1, 2017

(54) DRUM STAND BASKET WITH SPRING ADJUSTMENT AND OTHER FEATURES

(71) Applicant: Drum Workshop, Inc., Oxnard, CA (US)

(72) Inventors: Richard A Sikra, Thousand Oaks, CA (US); Ruben Steinhauser, Altusried (DE)

(73) Assignee: DRUM WORKSHOP, INC., Oxnard, CA (US)

( * ) Notice: Subject to any disclaimer, the term of this patent is extended or adjusted under 35 U.S.C. 154(b) by 0 days.

(21) Appl. No.: 15/002,373

(22) Filed: Jan. 20, 2016

(65) Prior Publication Data

US 2016/0210943 A1 Jul. 21, 2016

Related U.S. Application Data

(60) Provisional application No. 62/106,166, filed on Jan. 21, 2015.

(51) Int. Cl.
*G10D 13/02* (2006.01)

(52) U.S. Cl.
CPC ..... *G10D 13/026* (2013.01)

(58) Field of Classification Search
USPC ..... 84/421
See application file for complete search history.

(56) References Cited

U.S. PATENT DOCUMENTS 1,837,637 A * 12/1931 Walberg ..... B65G 65/24 248/171
3,405,588 A * 10/1968 Della-Porta ..... G10D 13/026 84/421
2007/0199429 A1* 8/2007 Hsieh ..... G10D 13/026 84/422.1
2015/0243268 A1* 8/2015 Miyajima ..... G10D 13/026 84/421

* cited by examiner

*Primary Examiner* — Christopher Uhlir
(74) *Attorney, Agent, or Firm* — Koppel, Patrick, Heybl & Philpott

(57) ABSTRACT

Drum stands and drum stand baskets, including those for use with a snare drum, are described. Drum stands and drum stand baskets according to the present disclosure can include an adjustment feature which enables the basket to fit differently sized drums. Additionally, drum stands and drum stand baskets according to the present disclosure can include elements which result in less interference with the sound of a snare drum compared to a snare drum in a prior art drum stand. Finally, embodiments of the present disclosure can be compacted for easy storage or transport.

20 Claims, 10 Drawing Sheets

DRUM STAND BASKET WITH SPRING ADJUSTMENT AND OTHER FEATURES

This application claims the benefit of U.S. Provisional Patent Application 62/106,166 to Sikra et al., filed on Jan. 21, 2015, which is fully incorporated by reference herein in its entirety.

BACKGROUND OF THE INVENTION

Field of the Invention

This invention relates generally to drum stands, and in particular to snare drum stands, and more particularly to snare drum stands and baskets of snare drum stands.

Description of the Related Art

Snare drums are common and widely used percussion instruments. The snare drum can sometimes be the center component and most prominent piece in a drum set. Snare drums are frequently used in orchestras, marching bands, concert bands, parades, drum corps, and many other applications. Because the snare drum is relatively easy to strike, it is highly accessible and often used in teaching.

Snare drums are usually double-sided drums, such that either head of the drum can be struck. Snare drums often come equipped with rattles, also called snares, metal wire, synthetics, and/or other devices that are stretched across one, or sometimes both, of the drum heads. Usually, a single set of snares is on the underside of the bottom, or unplayed, drum head. When the top drum head is struck, the snares on the bottom drum head resonate to give the snare drum its distinctive pitch. Band/orchestral, drum kit, and marching snare drums often use this type of snare.

Snare drum stands are often used in settings where the drummer is sitting, such as in bands/orchestras and drum kits. A common problem with snare drum stands is that they can be heavy and difficult to move. Additionally, some snare drum stands lack the ability to collapse, which makes them difficult to store.

Another common problem with snare drum stands is that when the snare drum is sitting on the stand, the stand can alter the tone of the drum. This can be caused by the stand muting the ringing of the drum. This can result in a less than desirable sound which is altered from the ideal or true tone of the drum without the influence of the stand.

Accordingly, there is a present need for a novel and efficient design for a drum stand, such as a snare drum stand, which specifically deals with the aforementioned problems.

SUMMARY OF THE DISCLOSURE

The present disclosure relates to stands for use with an instrument, such as for a drum like a snare drum. Drum stand baskets according to the present disclosure can include, among other things, features which enable a drum stand and/or drum stand basket to be used with differently-sized snare drums; enable playing of the drum with a less distorted or undistorted sound compared to those drums played on prior art drum stand baskets; and/or enable compact storage and transport of a drum stand and/or drum stand basket.

One embodiment of a drum stand basket according to the present disclosure can include a center piece with an opening, and a spring attached to the center piece. An arm adjustment device can be attached to the second end of the spring. A first basket arm can be placed through the center piece opening and at least partially through an opening in the arm adjustment device and then locked into place using a connector.

Another embodiment of a drum stand basket according to the present disclosure can include a plurality of drum stand arms each including a drum holder. Each of the drum holders can include a ledge and a lip. The drum stand basket can be configured to hold a snare drum rim between the plurality of ledges and lips.

One embodiment of a drum stand according to the present disclosure can include a drum basket including a center piece and three arms attached to the center piece. At least two of the arms can be rotatable about the center piece.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION OF THE DISCLOSURE

Figure 1:
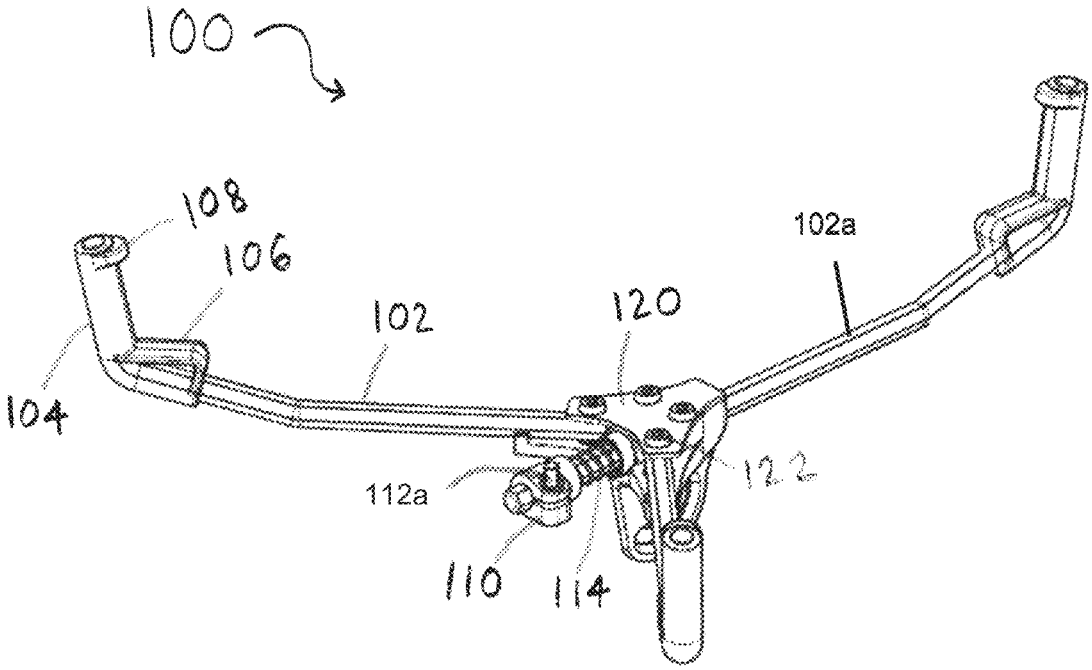
FIG. 1 is a perspective view of one embodiment of a drum basket according to the present disclosure.

The present disclosure relates to drum and/or cymbal stands and assemblies, such as snare drum stands, and the snare drum stand baskets. Embodiments of the present disclosure can include features for enabling use with differently sized drums, allowing better sound quality due to a novel drum holding concept, and/or enabling easy compacting and/or storage.

Throughout this disclosure, the preferred embodiment and examples illustrated should be considered as exemplars, rather than as limitations on the present disclosure. As used herein, the term "invention," "device," "apparatus,"

"method," "present invention," "present device," "present apparatus" or "present method" refers to any one of the embodiments of the disclosure described herein, and any equivalents. Furthermore, reference to various feature(s) of the "invention," "device," "apparatus," "method," "present invention," "present device," "present apparatus" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. In contrast, when an element is referred to as being "directly on" or extending "directly onto" another element, there are no intervening elements present. Additionally, it is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Furthermore, relative terms such as "inner," "outer," "upper," "top," "above," "lower," "bottom," "beneath," "below," and similar terms, may be used herein to describe a relationship of one element to another. Terms such as "higher," "lower," "wider," "narrower," and similar terms, may be used herein to describe angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention. As used herein, the term "and/or" includes any and all combinations of one or more of the associated list items.

The terminology used herein is for the purpose of describing particular embodiments only and is not intended to be limiting of the invention. As used herein, the singular forms "a," "an," and "the" are intended to include the plural forms as well, unless the context clearly indicates otherwise. For example, when the present specification refers to "an" assembly, it is understood that this language encompasses a single assembly or a plurality or array of assemblies. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

It is understood that while the present disclosure makes reference to baskets and stands for use with drums, such as snare drums, and that snare drum stands are the primary application concerned with the present invention, devices incorporating features of the present invention can be utilized with any application that has components or elements which might be used with drums and/or cymbals.

Embodiments of the invention are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the invention.

FIG. 1 is a perspective view of one embodiment of a drum basket 100 for use with a snare drum stand and/or snare drum according to the present invention. Drum basket 100 can comprise arms 102, drum holders 104, drum holder ledges 106, and/or drum holder lips 108. Drum basket 100 can also comprise arm adjustment device 110, one or more connectors such as the connectors 112*a* and 116, spring 114, center piece 120, and/or screws 122. Connectors in embodiments of the present invention such as the connector 112*a* can include many different types of connectors as known in the art, such as drum key screws, screws, nuts, bolts, nails, pins, and other similar and dissimilar devices serving the purpose of connecting two things. As displayed in FIG. 1, some embodiments of drum stand baskets according to the present invention can include three arms 102, as well as three drum holders 104, three drum holder ledges 106, and/or three drum holder lips 108. However, it is understood that drum basket 100 can comprise any number of arms, drum holders, drum holder ledges, and/or drum holder lips, including but not limited to one, two, four, or more arms, as well as any number of other components that are described herein.

As mentioned previously, drum basket 100 can be very light in weight. Accordingly, all of the components in drum basket 100 can be lightweight. For example, arms 102 can comprise a lightweight and/or sturdy material, including plastics, composites, and/or metals, such as titanium. However, it is understood that arms 102 can be made of any material. Drum holders 104, drum holder ledges 106, and/or drum holder lips 108 can be made of rubber, plastic, and/or any appropriate material for holding a drum. Further, the additional components in drum basket 100 can be both lightweight and/or sturdy. As such, arm adjustment device 110, connector 112, spring 114, center piece 120, screws 122, and/or any additional component can be made of lightweight and/or sturdy materials, such as plastics, composites, and/or metals, although it is understood that many different materials can be used.

Additionally, drum basket 100 can be adjustable, so as to fit different drum sizes. In some embodiments of the present invention, one of the arms 102 can be adjusted in length to fit drums with different diameters. However, it is understood that in other embodiments, the length of any one or more of arms 102 can be adjusted. Moreover, the one or more of the arms 102, and in some embodiments all of the arms 102, can rotate and/or swivel in order to adjust to different drum diameters. As discussed in further detail below, the arms 102 that rotate and/or swivel can also collapse to facilitate easier storage of the drum basket 100.

Figure 2:
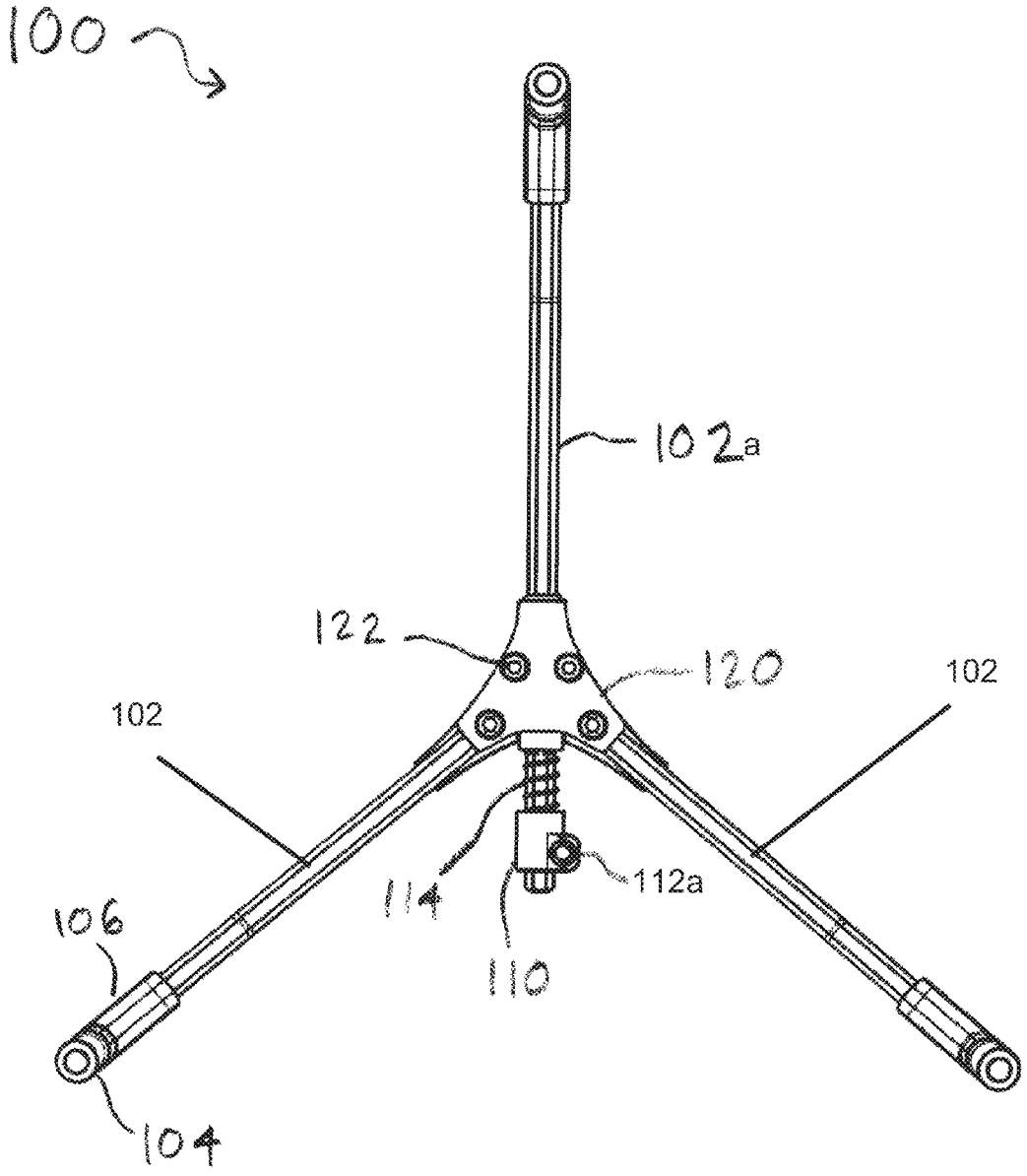
FIG. 2 is a top view of the drum basket shown in FIG. 1.
Figure 3:
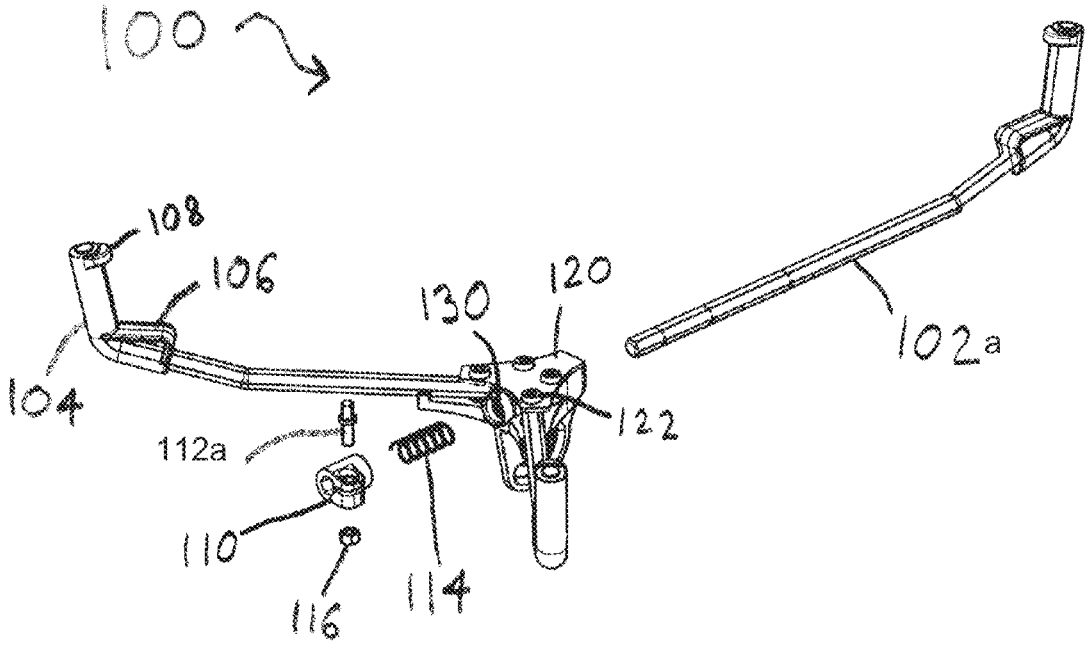
FIG. 3 is an exploded perspective view of the drum basket shown in FIG. 1.

FIG. 2 is a top view of drum basket 100, while FIG. 3 is an exploded perspective view of drum basket 100. As shown in FIGS. 1-3, one of the arms 102*a* can extend from the center piece 120 opposite said arm adjustment device 110. In one example, the arm 102*a* can extend through center piece 120 by entering center arm opening, hole, or aperture 130, shown in detail in FIG. 3. The arm 102*a* can also continue partially or completely through a spring 114 and/or arm adjustment device 110, such as through an opening, aperture, and/or hole of the arm adjustment device 110, which can be axial in some embodiments. The spring 114 can be attached and/or attachable to the arm adjustment device 110 and attached and/or attachable to the center piece 120

In the specific embodiment shown, the length of the arm 102*a*, opposite arm adjustment device 110, can be adjusted. In order to adjust the length of the aforementioned arm 102*a*, connector 112 can be unlocked, loosened, and/or removed, which can allow arm 102*a* to move in and/or out of center arm opening 130 and/or an opening, hole, or aperture within the arm adjustment device 110. To unlock, loosen, and/or remove connector 112, the connector 112 can be pulled up and/or pushed down, screwed in and/or screwed out, and other actuation means known in the art. As displayed in FIG. 3, connector 112 can go through arm adjustment device 110 and/or enter into another connector such as a nut 116. Once the desired length of arm 102*a* is achieved, connector 112, arm adjustment device 110 and/or spring 114 can be placed back in their locked position.

It is understood that the length of arm 102 can be adjusted without using all of the aforementioned components, as well as by using any other component described herein.

In some embodiments, the other remaining arms 102 can be rotated and/or swiveled to fit different sizes of snare drums. In these embodiments, in order to rotate and/or swivel the remaining arms 102, connector 112 can be unlocked, loosened, and/or removed. In other embodiments, arms 102 can be rotated by unlocking, loosening, and/or removing screws 122. Nonetheless, it is understood that arms 102 may be rotated and/or swiveled, as well as adjusted in length, by many different ways. In addition to arms 102, any other components in drum basket 100, including but not limited to drum holders 104, drum holder ledges 106, and/or drum holder lips 108, can be adjusted and/or rotated to fit snare drums of different sizes.

The spring 114 can be biased to return the arm 102*a* to its position as locked by the connector 112. For example, if a user pulls the arm 102*a* outward and away from the center piece 120, and/or if a user pushes the arm 102*a* inward toward the center piece 120, the spring can return the arm 102*a* to its locked position or near its locked position upon the release of this force. This can help to prevent unintentional movement of a snare drum, and/or can help to ensure that the snare drum stays tight within the basket 100. Further, a user can set the locked position of the arm 102*a* to be slightly shorter than the necessary length for the desired snare drum. Then, the user can set the snare drum such that the arm 102*a* is biased against the snare drum edge by the spring 112. Next, the user can rotate the other arms 102 so as to be against the snare drum, all the arms 102 including arm 102*a* holding the snare drum in place.

In some embodiments, arms 102 can be adjusted so that drum basket 100 can fit snare drums between about 12 and about 15 inches in diameter, inclusive, although other embodiments are possible. For example, some drum baskets according to the present invention can fit snare drums between about 6 and about 30 inches in diameter, inclusive; and/or between about 7.5 and about 25 inches in diameter, inclusive; and/or between about 9 and about 18 inches in diameter, inclusive. It is understood that drum basket 100 can be adjusted to fit snare drums and/or other drums of any size diameter.

Figure 4:
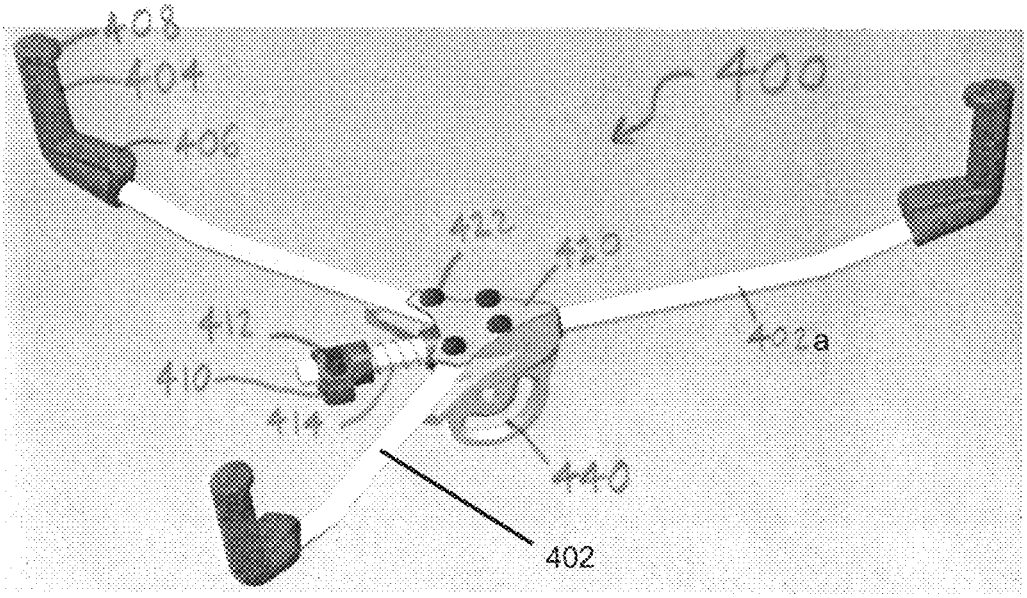
FIG. 4 is a perspective view of another embodiment of a drum basket according to the present disclosure.

FIG. 4 is a perspective view of another embodiment of a drum basket 400 according to the present invention. It is understood that the features of the drum basket 100 and drum stand 800 (described below) can be incorporated into embodiments of the drum basket 400, and vice versa. Drum basket 400 can comprise arms 402 including an arm 402*a*, drum holders 404, drum holder ledges 406, and/or drum holder lips 408. Drum basket 400 can also comprise arm adjustment device 410, connector 412, spring 414, center piece 420, and/or screws 422. It is understood that these elements can be similar to or equivalent to those corresponding elements described with regard to the drum basket 100, or can be different. Furthermore, drum basket 400 can comprise angle adjustment opening 440, which can adjust the tilt of the drum basket 400 so that a user can achieve their desired snare drum tilt. In order to adjust the tilt of drum basket 400, angle adjustment opening 440 can work along with a tilt adjustment knob, as described below.

Figure 5:
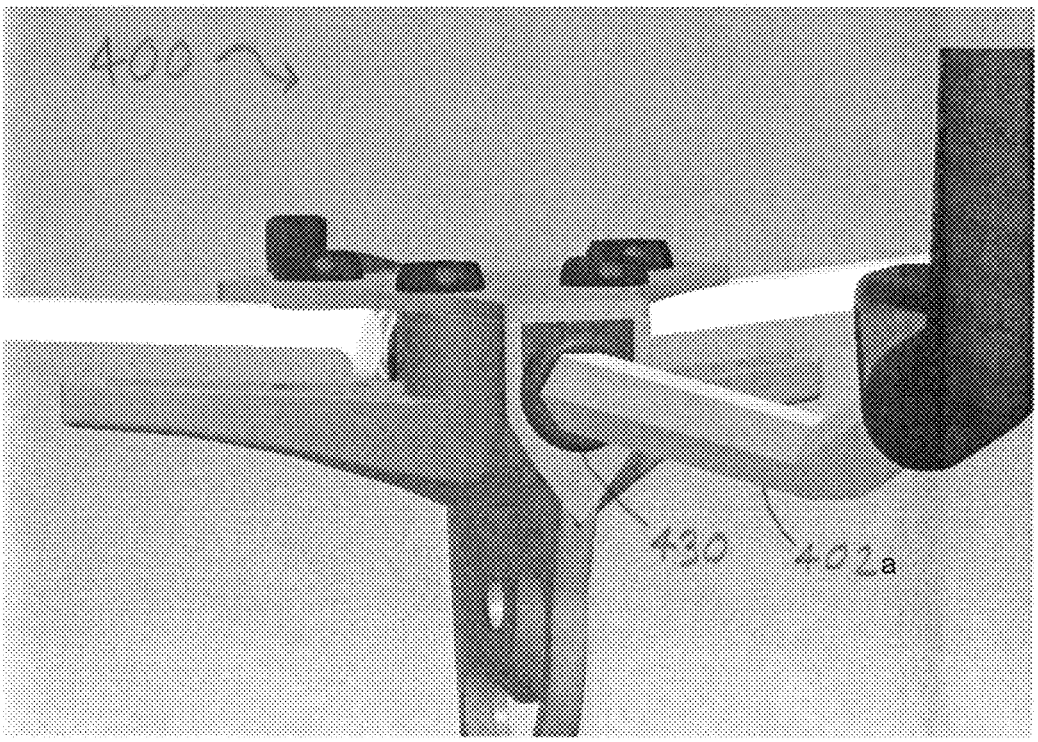
FIG. 5 is a magnified side view of a portion of the drum basket shown in FIG. 4.

FIG. 5 is a close-up side view of drum basket 400 according to one embodiment of the present invention. Some components shown in FIG. 5 include arm 402*a* and center arm opening 430. As shown in FIG. 5, arm 402*a* can have a hexagonal cross-section. Many other cross-sections are possible, including but not limited to square, rectangular, round, oblong, pentagonal, octagonal, or any other regular or irregular polygon. In the specific embodiment shown, center arm opening 430 also has a hexagonal cross-section. It is understood that center arm opening 430 can have any cross-section, including but not limited to those described above with regard to arm 402*a*. Center arm opening 430 can have the same shape as arm 402*a* so as to accommodate arm 402*a* (although it is understood that it may also have a different shape).

The hex-to-hex connection of arm 402*a* and center arm opening 430 in FIG. 5 can provide stability for arm 402*a*. For example, because there are more sides to align compared to a system including circular or rectangular cross-sections, the connection between arm 402*a* and center arm opening 430 can be more secure, allowing for easier user control of a snare drum and drum basket 400. It is understood that the other arms 402 can have the same or different cross-sectional shapes as the arm 402*a*.

Figure 6:
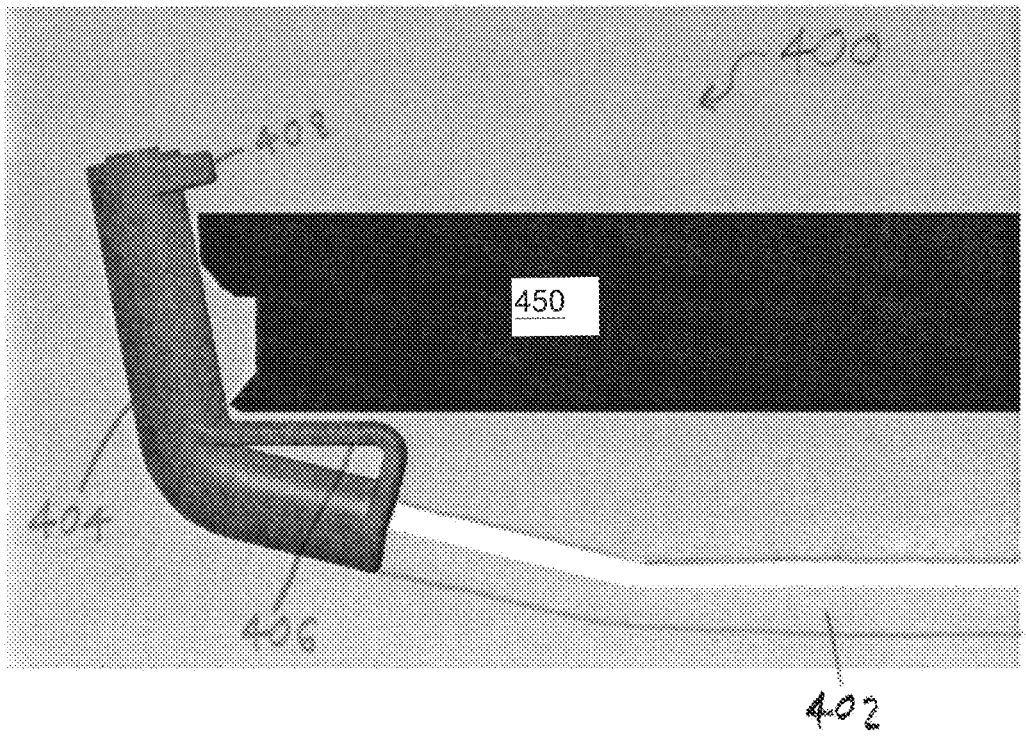
FIG. 6 is another magnified side view of a portion of the drum basket shown in FIG. 4.

FIG. 6 is another close-up side view of drum basket 400 according to one embodiment of the present invention. Drum basket 400 can comprise arm 402, drum holder 404, drum holder ledge 406, and/or drum holder lip 408. As displayed in FIG. 6, drum holder ledge 406 and/or drum holder lip 408 can extend from drum holder 404. As such, a snare drum 450 can rest on drum holder ledge 406 and/or below drum holder lip 408.

In many snare drum stands known in the art, the snare drum will rest directly on the arms of the snare drum stand basket. As a result, the snare drum is on a hard surface, which can mute and/or "choke" the drum causing the tone of the drum to be altered. In contrast, because of the existence of drum holder ledge 406 and/or drum holder lip 408, snare drums used with drum basket 400 need not rest directly on arm 402. Indeed, a snare drum resting on drum holder ledge 406, such as below drum holder lip 408, and/or between drum holder ledge 406 and drum holder lip 408 will be able to move naturally and/or float as it is played, without the bottom of the inner portions of the snare drum 450 contacting drum arms 402. Accordingly, drum holder ledge 406 and/or drum holder lip 408 can work separately and/or together to hold a snare drum. As such, drum holder ledge 406 and/or drum holder lip 408 can allow the tone of a snare drum to remain unaltered and/or substantially unaltered, and/or to reduce any alterations that would be caused by a typical stand or basket, while the drum is being played on drum basket 400. Thus, the drum basket 400 according to one embodiment of the present invention can help a user experience a substantially unaltered, improved, and/or ideal snare drum tone.

Figure 7:
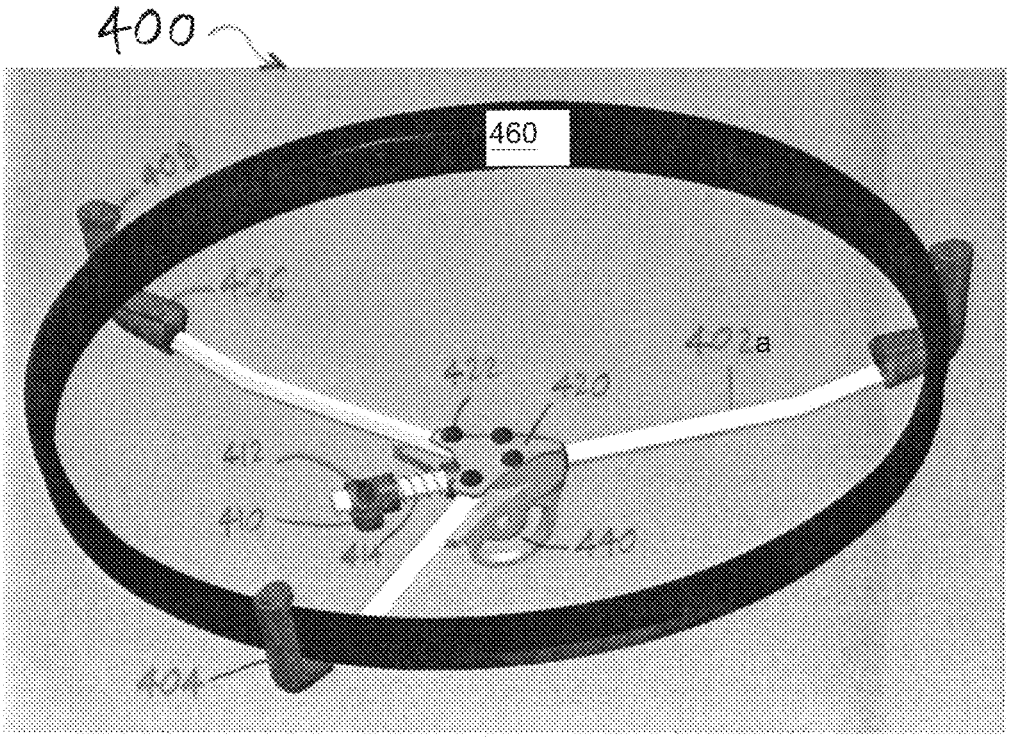
FIG. 7 is another perspective view of the drum basket shown in FIG. 4.

FIG. 7 is another perspective view of drum basket 400 according to one embodiment of the present invention. FIG. 7 displays the relationship between drum basket 400 and a snare drum rim 460. As discussed above, arms 402 can be adjusted in length, as well as rotated and/or swiveled, in order to better hold a snare drum. As mentioned previously, in some embodiments, arms 402 can be adjusted so that drum basket 400 can fit snare drums that are various sizes, such as between about 12 inches and about 15 inches in diameter (although it is understood that, as previously described, many different sizes are possible). It is understood that drum basket 400 can be adjusted to fit snare drums and/or other drums of any size diameter.

Figure 8:
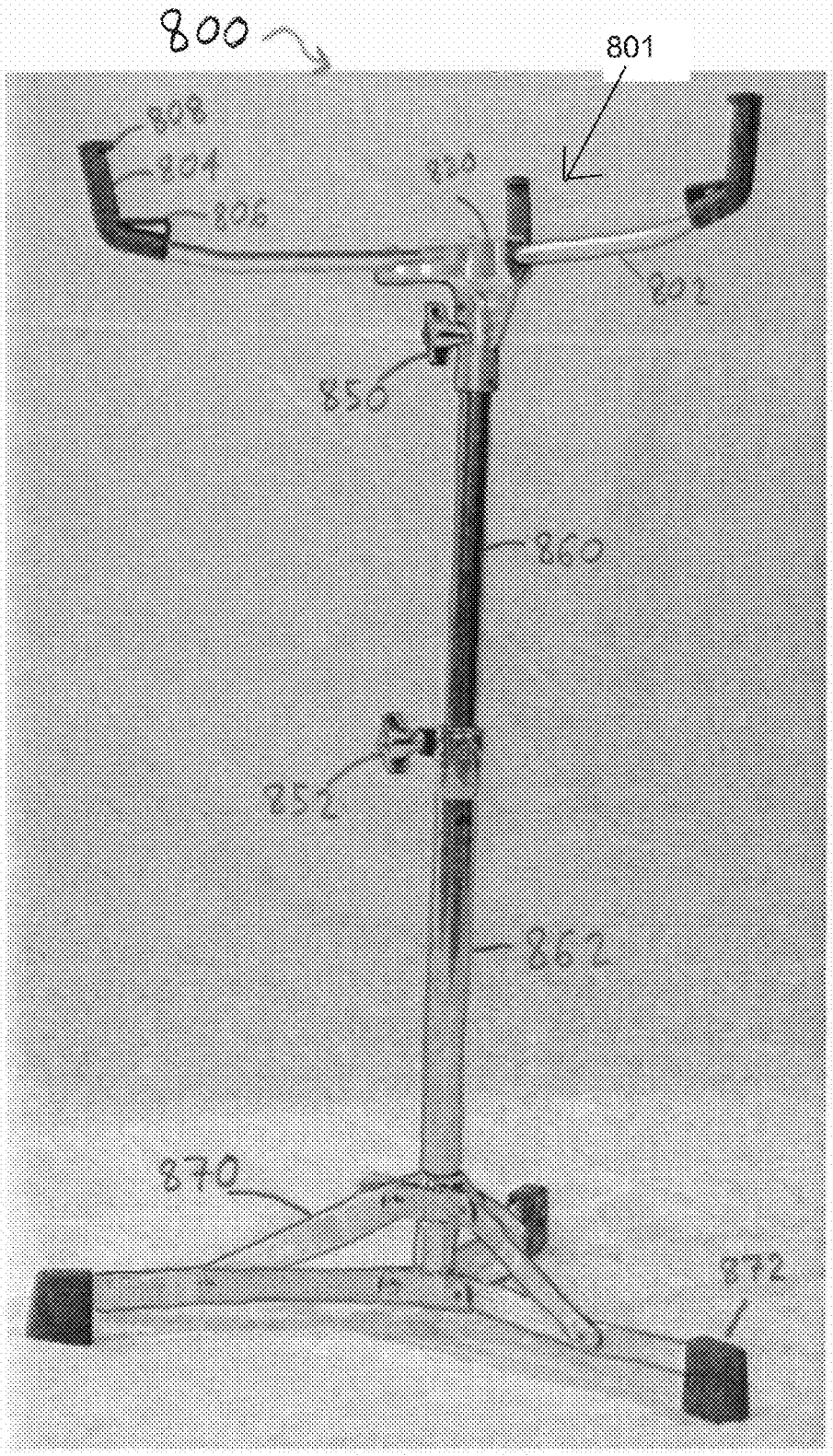
FIG. 8 is a side perspective view of another embodiment of a drum stand according to the present disclosure.

FIG. 8 is a side perspective view of another embodiment of snare drum stand 800 according to one embodiment of the present invention. It is understood that the features of the drum baskets 100,400 can be incorporated into embodiments of the drum stand 800, and vice versa. Snare drum stand 800 can comprise a basket 801, arms 802, drum holders 804, drum holder ledges 806, drum holder lips 808, center piece 820, tilt adjustment knob 850, shaft adjustment knob 852, upper shaft 860, lower shaft 862, base 870, base legs 871, and/or base tips 872. It is understood that some of these elements may be eliminated, combined, or split, and other elements may be added, in embodiments of the present invention.

Shaft adjustment knob 852 can be loosened so that the length of upper shaft 860 can be adjusted. Upper shaft 860 can raise up and/or drop down and into lower shaft 862. Upper shaft 860 is fully collapsible into lower shaft 862, which facilitates storing snare drum stand 800. Lower shaft 862 can connect to base 870, wherein snare drum stand 800 rests on base 870 and base tips 872. Base tips 872 can comprise rubber and/or any appropriate material to hold and support the rest of snare drum stand 800.

Figure 9:
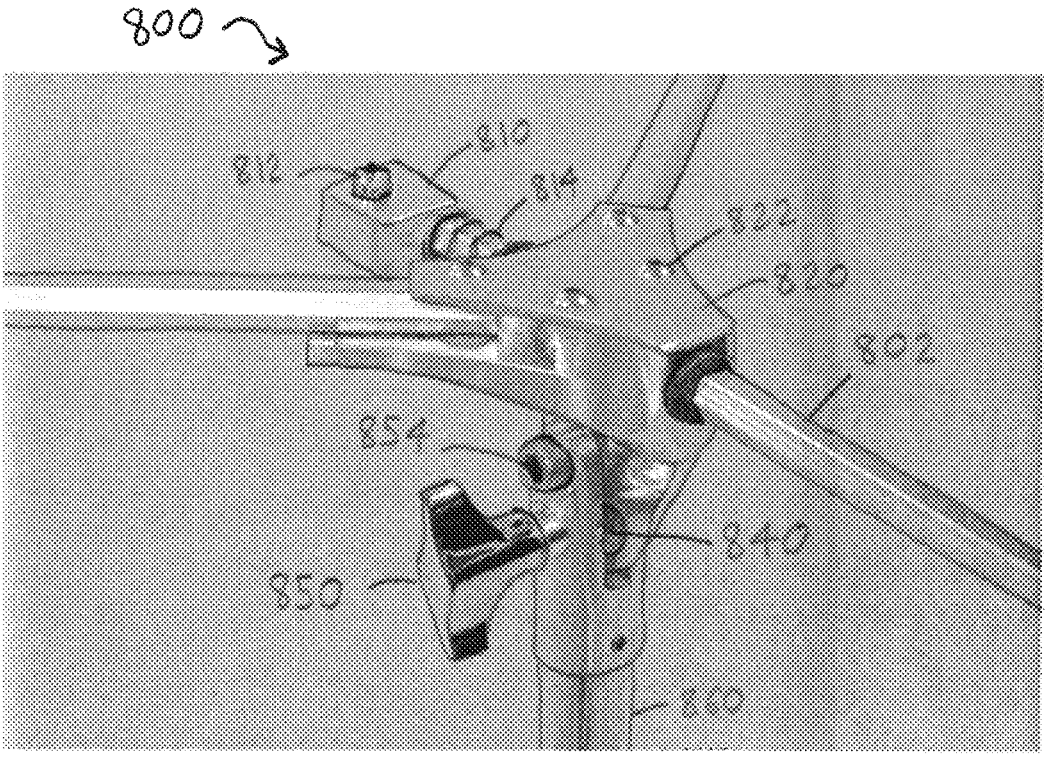
FIG. 9 is a magnified perspective view of a portion of the drum stand shown in FIG. 8.

FIG. 9 is a close-up perspective view of snare drum stand 800 according to one embodiment of the present invention. As displayed in FIG. 9, snare drum stand 800 can comprise arms 802, arm adjustment device 810, connector 812, spring 814, center piece 820, screws 822, angle adjustment opening 840, tilt adjustment knob 850, rotation adjustment knob 854, and/or upper shaft 860. As mentioned previously, angle adjustment opening 840 can adjust the tilt of snare drum stand 800 so that a user can achieve their desired snare drum tilt.

In order to adjust the tilt of snare drum stand 800, angle adjustment opening 840 can work along with a tilt adjustment knob 850 and/or rotation adjustment knob 854. For example, when tilt adjustment knob 850 and/or rotation adjustment knob 854 is loosened, the upper portion of basket 801, including arms 802, can be tilted. In one embodiment, this tilt adjustment requires both tilt adjustment knob 850 and rotation adjustment knob 854 to be loosened. In another embodiment, only one of these elements need be loosened. In yet another embodiment, one of these features is omitted, and the remaining feature must be loosened in order to allow the tilt adjustment. Many different embodiments are possible.

In one embodiment, loosening of tilt adjustment knob 850 can allow the basket 801 to rotate within angle adjustment opening 840. Once the user has selected a desired angle of tilt, tilt adjustment knob 850 can be tightened to lock the tilt angle into place. Accordingly, a user can adjust the tilt of snare drum stand 800 to correspond to his/her desired playing angle of a snare drum. Similarly, in another embodiment, loosening of rotation adjustment knob 854 can allow the basket 801 to rotate within the angle adjustment opening 840, and then rotation adjustment knob 854 can be tightened to lock the tilt angle into place. In yet another embodiment, loosening of tilt adjustment knob 850 and rotation adjustment knob 854 allows the basket 801 to rotate within the angle adjustment opening 840, and then tightening of both the tilt adjustment knob 850 and rotation adjustment knob 854 locks the tilt angle into place.

Figure 10:
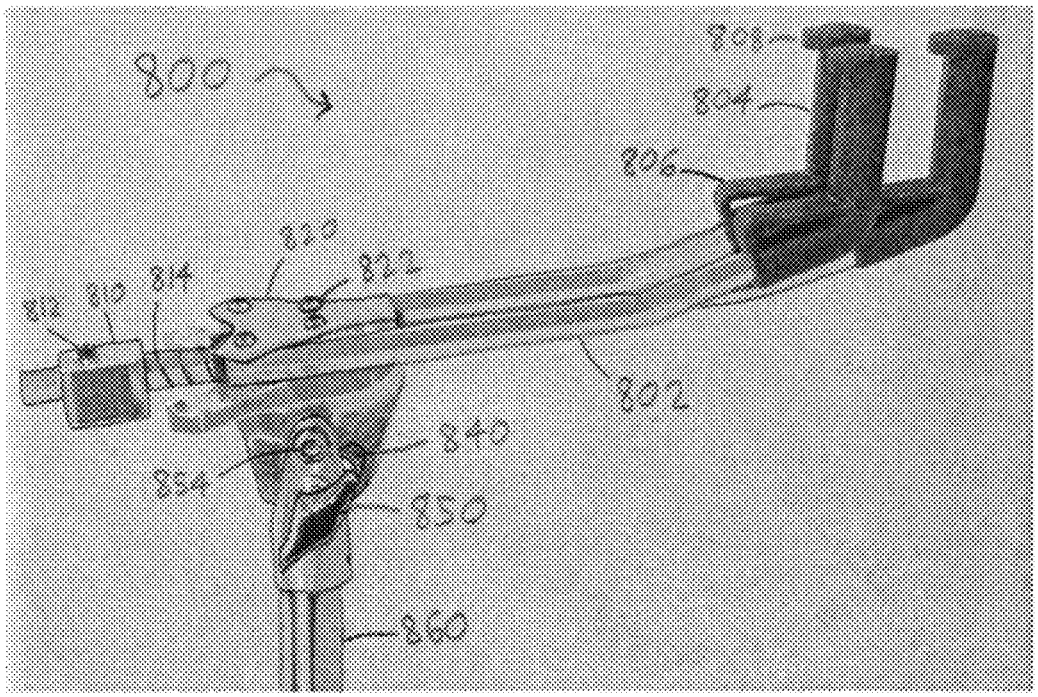
FIG. 10 is another magnified perspective view of the drum stand shown in FIG. 8.

FIG. 10 is another close-up perspective view of snare drum stand 800 according to one embodiment of the present invention. As shown, snare drum stand 800 can comprise arms 802, drum holders 804, drum holder ledges 806, drum holder lips 808, arm adjustment device 810, connector 812, spring 814, center piece 820, screws 822, angle adjustment opening 840, tilt adjustment knob 850, rotation adjustment knob 854, and/or upper shaft 860.

As discussed above with regard to drum stand basket 100, arms of drum stands and/or drum baskets according to the present invention can be rotatable. FIG. 10 displays that arms 802 can rotate and/or swivel to collapse into one another, which can facilitate storing of the snare drum stand 800 and/or drum basket 801. For instance, when arm connector 812, adjustment device 810, and/or spring 814 are unlocked and/or loosened, arms 802 can rotate and collapse together. As shown in FIG. 10, all three arms 802 can be rotated to come together for easy storage.

Additionally, tilt adjustment knob 850 and/or rotation adjustment knob 854 can be loosened to allow arms 802 to rotate in a downward direction. Arms 802 can then rotate down so that they collapse into upper shaft 860 and/or lower shaft 862. In this manner, arms 802, upper shaft 860, and/or lower shaft 862 can come together to facilitate storing the snare drum stand 800. Accordingly, snare drum stand 800 is highly collapsible.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain configurations thereof, other versions are possible. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

We claim:

1. A drum stand basket, comprising:

a center piece comprising an opening, said opening comprising a first opening end and a second opening end;

a spring comprising a first spring end and a second spring end, said first spring end attached to said center piece proximate said first opening end;

an arm adjustment device attached to said second spring end, said arm adjustment device comprising an aperture;

a first basket arm at least partially within said opening and at least partially within said aperture;

a first connector on said arm adjustment device, said first connector configured to lock said first basket arm into a first position.

2. The drum stand basket of claim 1, further comprising second and third basket arms;

wherein said second basket arm is attached to said center piece by a second connector and said third basket arm is attached to said center piece by a third connector.

3. The drum stand basket of claim 2, wherein said second basket arm is rotatable about said second connector and said third basket arm is rotatable about said third connector.

4. The drum stand basket of claim 3, wherein said second basket arm is rotatable about said second connector when said second connector is loosened, and wherein said third basket arm is rotatable about said third connector when said third connector is loosened.

5. The drum stand basket of claim 4, wherein said second basket arm and said third basket arm are rotatable so as to touch said first basket arm.

6. The drum stand basket of claim 1, wherein when said first connector has locked said first basket arm into said first position, said spring is biased to return said first basket arm to said first position upon removal of said first basket arm from said first position.

7. The drum stand basket of claim 6, wherein said second and third basket arms are rotatable about said center piece.

8. The drum stand basket of claim 7, wherein said second and third basket arms are rotatable about said center piece in a substantially horizontal plane.

9. A drum stand comprising:

a basket center piece comprising an opening, said opening comprising a first opening end and a second opening end;

first, second, and third drum stand arms attached to said basket center piece;

a spring comprising a first spring end and a second spring end, said first spring end attached to said basket center piece proximate said first opening end;

an arm adjustment device attached to said second spring end, said arm adjustment device comprising an aperture; and a first connector on said arm adjustment device, said first connector configured to lock said first drum stand arm into a first position;

wherein said first drum stand arm is at least partially within said opening and at least partially within said aperture; and wherein at least said second and third drum stand arms are rotatable about said basket center piece.

10. The drum stand of claim 9, wherein at least two of said first, second, and third drum stand arms comprises a drum holder;

wherein each of said drum holders comprises a ledge and a lip; and wherein said drum stand is configured to hold a snare drum rim between said ledges and said lips.

11. The drum stand of claim 10, wherein said drum stand is configured to hold said snare drum rim between tops of said ledges and bottoms of said lips.

12. The drum stand of claim 10, wherein each of said drum holders is on an end of its respective one of said first, second, and third drum stand arms.

13. The drum stand basket of claim 12, wherein each of said drum stand arm ends is angled upward.

14. The drum stand of claim 9, wherein said basket center piece comprises an angle adjustment mechanism shaped to define an angle adjustment opening.

15. The drum stand of claim 14, wherein said angle adjustment opening has a curved path.

16. The drum stand of claim 14, further comprising a shaft piece shaped to define a shaft opening;

wherein said angle adjustment mechanism is attached to said shaft piece within said shaft opening.

17. The drum stand of claim 16, further comprising a tilt adjustment knob holding said angle adjustment mechanism within said shaft opening.

18. The drum stand of claim 17, wherein said drum stand is configured such that actuation of said tilt adjustment knob tilts said basket center piece.

19. The drum stand of claim 18, wherein said drum stand is configured such that said first, second, and third drum stand arms can be tilted so as to be substantially vertical.

20. The drum stand of claim 19, further comprising one or more base legs below said shaft piece;

wherein said one or more base legs can be tilted upward so as to be substantially vertical.

* * * * *